United States Patent [19]

Chapelain et al.

[11] Patent Number: 5,014,822

[45] Date of Patent: May 14, 1991

[54] METHOD FOR INSTALLING AN ELEVATOR INSIDE A BUILDING, AND ASSEMBLY JIGS USED THEREFOR

[75] Inventors: Jean-Claude Chapelain, Sainte Genevieve des Bois; Patrice P. Masson, Paris; Gerard C. Dupoty, Bruyeres Suroise; Gerard Crenn, Bagneux; Cloux, Jean-Noel, Les Choux, all of France

[73] Assignee: Otis Elevator Company, Farmington, Conn.

[21] Appl. No.: 393,911

[22] PCT Filed: Nov. 28, 1988

[86] PCT No.: PCT/FR88/00581

§ 371 Date: Jul. 26, 1989

§ 102(e) Date: Jul. 26, 1989

[87] PCT Pub. No.: WO89/04806

PCT Pub. Date: Jun. 1, 1989

[30] Foreign Application Priority Data

Nov. 27, 1987 [FR] France ..... 87 16497

[51] Int. Cl.[5] ..... B66B 7/02

[52] U.S. Cl. ..... 187/1 R; 187/95; 182/128; 52/30

[58] Field of Search ..... 52/745, 30, 79.1, 173 R; 29/429; 182/128, 179; 187/1 R, 2, 95; 269/37, 43, 44, 45

[56] References Cited

U.S. PATENT DOCUMENTS

| | | | |
|---|---|---|---|
| 3,851,736 | 12/1974 | Westlake et al. | 187/95 |
| 4,345,671 | 8/1982 | Tosato et al. | 187/95 |
| 4,356,890 | 11/1982 | Smart | 187/6 |
| 4,462,197 | 7/1984 | D'Alessio et al. | 182/179 X |

FOREIGN PATENT DOCUMENTS 1495075 9/1967 France .

*Primary Examiner*—Joseph E. Valenza
*Assistant Examiner*—Dean A. Reichard

[57] ABSTRACT

The present invention relates to a method of assembling an elevator within a building and the assembly jigs used therefor. According to this method, assembly jigs (1) including pre-positioned elevator elements such as rails, doors, counterweight and electrical conduit are positioned successively in a support shaft. These elements are secured without any other adjustment to the support shaft and the jig is then removed.

7 Claims, 4 Drawing Sheets

METHOD FOR INSTALLING AN ELEVATOR INSIDE A BUILDING, AND ASSEMBLY JIGS USED THEREFOR

The present invention relates to a method of assembling an elevator including a freight elevator (also herein referred to as a lift or goods lift) within a building and the assembly jigs used.

According to conventional techniques for assembling lifts in buildings, the lift or lifts are positioned when the structure of the building is finished and in particular when the lift shaft is formed. The equipment of the shaft (guide rails, doors and electric equipment for the lift) is positioned level by level from fixed or mobile scaffolding.

This method has the drawback of depending to a large extent on the erection of the building structure so that the beginning of lift assembly is tardy and so finishing of the lift is delayed. Furthermore, numerous adjustments must be made for adapting the lift to the building, particularly at the level of the thresholds of the floors of the building as well as the positioning of the guide rails.

The invention aims at overcoming these drawbacks and proposes a new method of assembling a lift or goods lift within a building, characterized in that it consists successively in :

- positioning and fixing the guide and equipment elements for the lift, such as the cabin guide rails and counterweight, the doors, the ducts, the electric equipment and ducts, on at least one assembly jig of predetermined height, such that they are disposed geometrically within the space of the jig with respect to each other in the exact position which they occupy when finally mounted in the support shaft;
- positioning and fixing the jig or jigs successively heightwise from the previously formed shaft bottom as far as the highest floor of the lift, in the support shaft which exists or is to be built;
- fixing said elements of the lift carried by the jig to the shaft if it exists or mounting the shaft so that the fixing points for these elements are secured to the shaft during building thereof;
- releasing said lift elements from the jig when they are fixed to the support shaft;
- releasing the jig from its fixing points, and
- removing the jig from said support shaft.

This arrangements means that the construction of the lift or of the goods lift may begin prior to the erection of the structure of the building and such erection may be carried out from the lift shaft. In practice, the construction of the lift will precede that of the building by one to several levels and advantageously by two floors.

Furthermore, the method makes possible a considerable saving in time and labour on the worksite since the lift elements are already set in their final position on the assembly jig and it is only a question of fixing them without any other adjustment to the support shaft (existing or to be built).

Thus, it is no longer necessary to store equipment elements on the worksite and the work conditions are much better particularly in so far as the difficulties and safety of execution are concerned.

Finally, the lift is rapidly available and may serve as a worksite goods lift for the building under construction.

The invention also relates to the assembly jigs for said method They comprise a rigid structure, made from metal for example, developed so as to correspond to the profile of the shaft and essentially designed for carrying said lift elements and sliding along the walls of the lift shaft. This structure also carries scaffolding elements, such as working levels disposed successively heightwise and adjustable and which make it possible to carry out the tasks level by level in all safety. The height of the jig may be several floors but in practice it will be limited to two floors.

The invention also relates to the lift or the goods lift thus obtained.

One embodiment of the invention will now be described with reference to the accompanying drawings in which.

Figure 1:
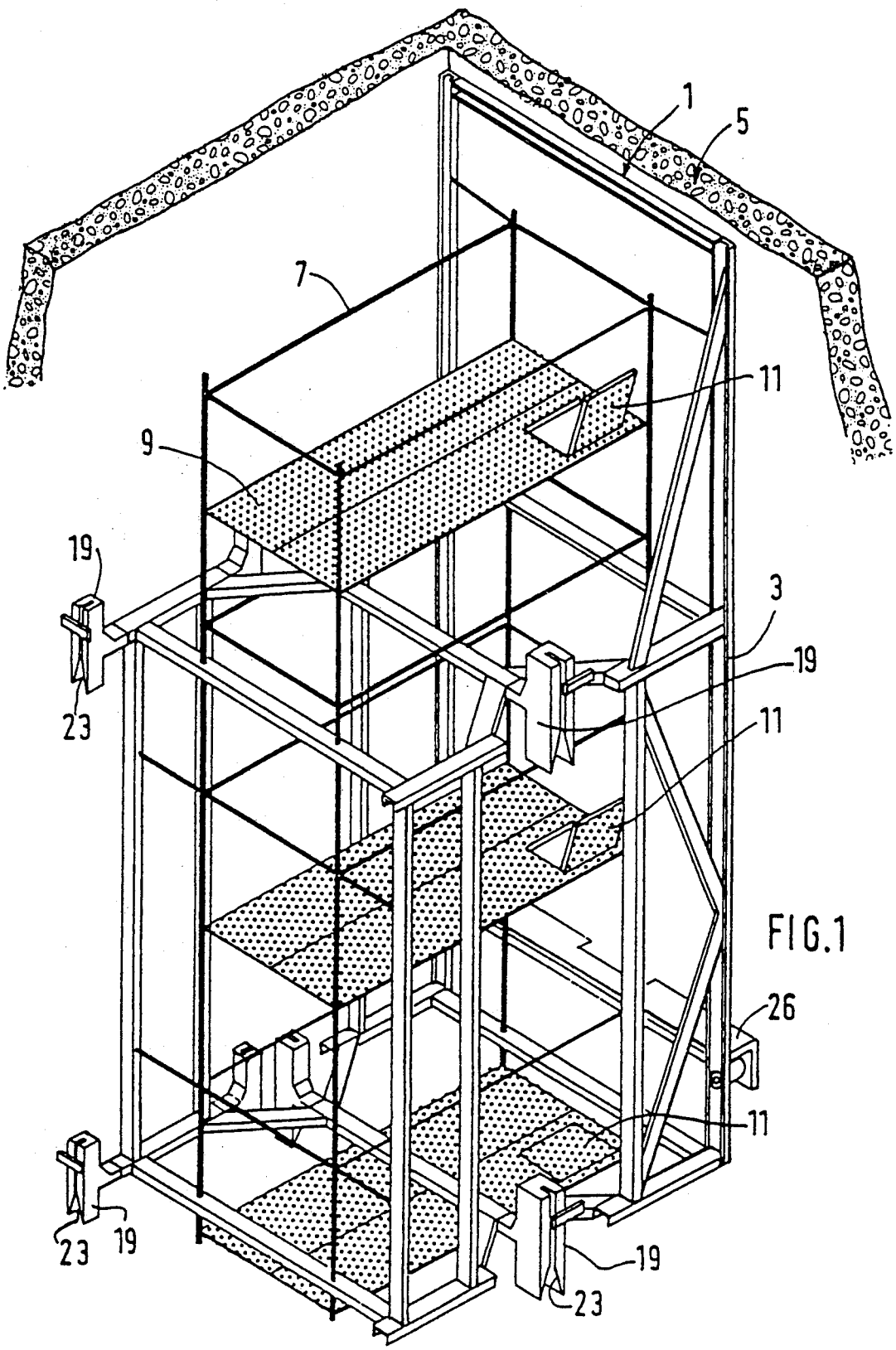
FIG. 1 is a perspective view of an assembly Jig according to the invention showing particularly the points at which the lift equipment elements are fixed to this jig.
Figure 2:
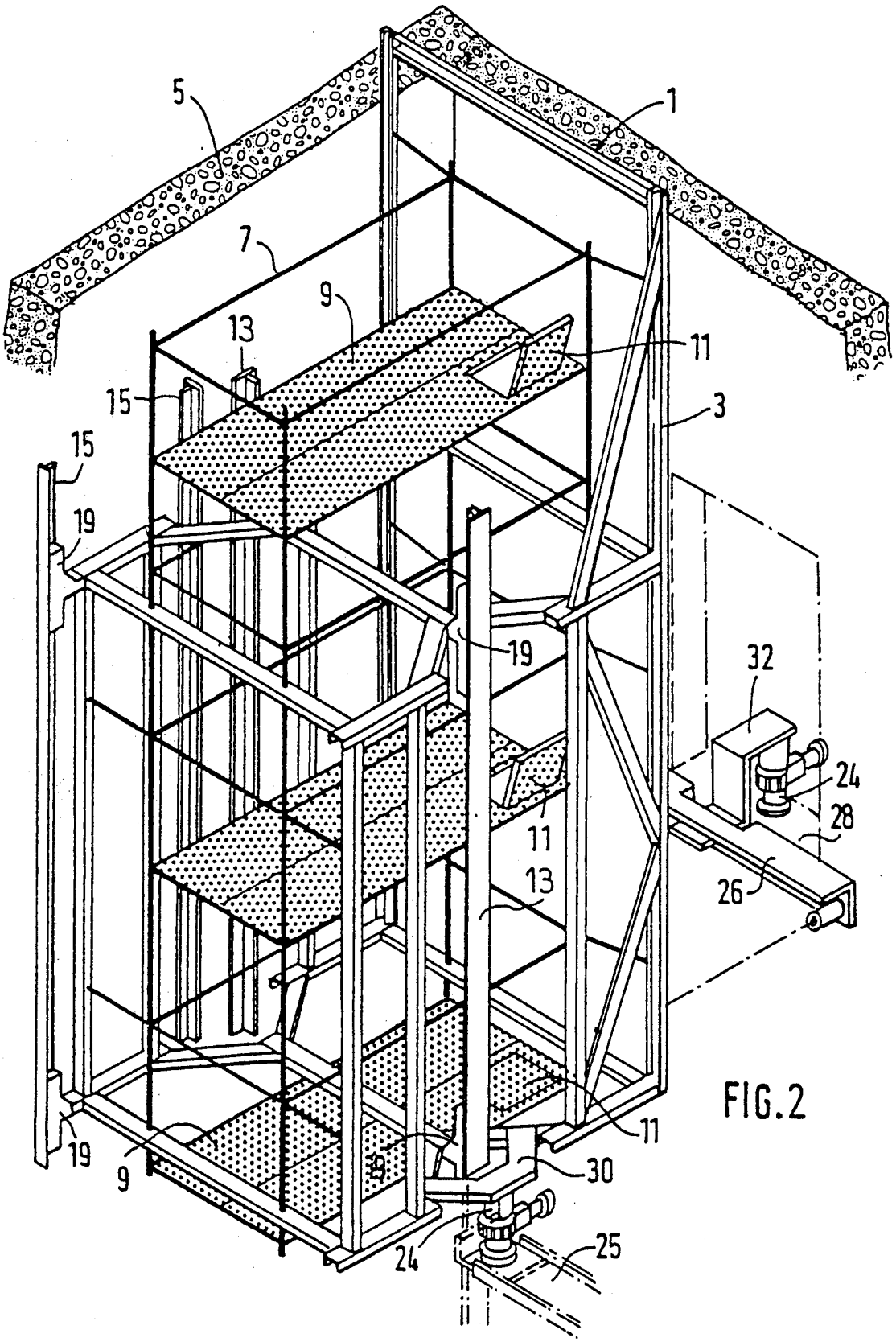
FIG. 2 shows an equipped jig and its positioning in the shaft.
Figure 4:
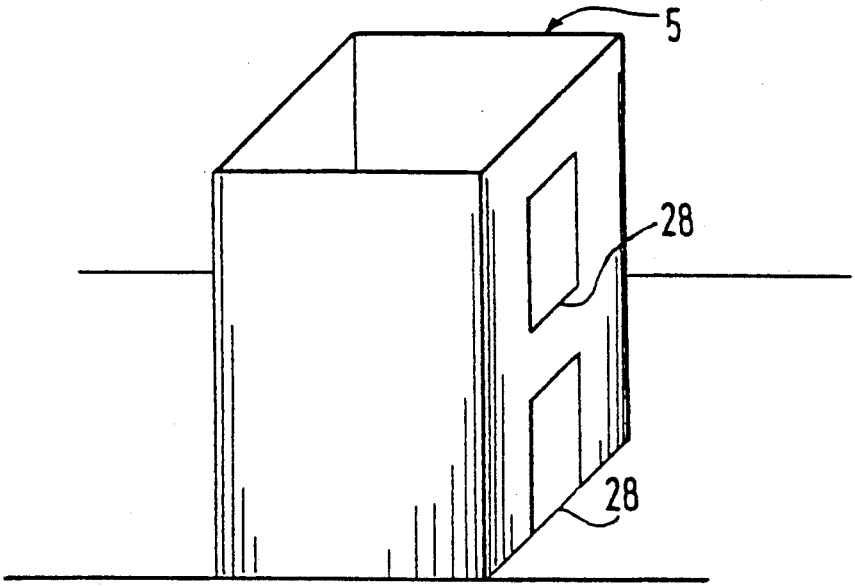
FIG. 4 shows schematically the construction of the lift with its partially built shaft relatively to the structure of the building.

As shown in FIG. 1, the assembly jigs 1 used in the method of the invention are each formed of a rigid frame 3 of a height corresponding to two floors of the lift and whose dimensions in the horizontal plane are slightly less than those of the inner section of the support shaft 5 so as to make possible introduction thereof inside in the space provided for this shaft, in the case where the latter has not yet been built. On this frame 3 are fixed scaffolding elements 7 and in particular three work levels 9 spaced apart heightwise and accessible from one to the other through traps 11 and ladders not shown. On these jigs are fixed (FIG. 2) the guide and equipment element of the list such as the guide rails 13 for the lift cabin, the guide rails 15 of the counterweight, the doors 17 and the electric equipment and ducts and counterweight not shown, these elements being prepositioned in the factory on the jig so as to correspond without any other adjustment to their final position when the jig is correctly positioned in the space of the support shaft. The rails are fixed to bolt elements 19 (two per rail, one in the lower part and the other in the upper part of the jig) fixed to the jig, the lower ends of these rails being in the same horizontal plane. The bolt elements 19 comprise a groove 23 widening downwards which receives the upper part of the lower guide rails already fixed to the support shaft, at the time of positioning the jig. This allows the jig to be positioned relatively to the guide rails already laid. The precise positioning of the jig (its verticality/horizontality) during positioning in the support shaft, is obtained by three jacks 24 disposed in a triangle. Two of these jacks are set on the upper fixing lugs 25 of the underlying cabin guide rail fixed to the shaft and the third on the threshold 28 of the floor opening, or on the top wall of the shaft if it is not yet built. These jacks support the jig through rigid portions 30, 32 provided for this purpose on the latter. When the jig is exactly positioned and fixed in position (by anchorage means) on the support shaft previously formed beforehand (two floors) in the height direction of the jig (FIG. 4), the elements carried by the jig are fixed as they are, without any other adjustment, to the latter (FIG. 2) through adjustable fixing lugs 25 for the rails and to elements of the bracket type 26 for the doors 17.

Figure 3:
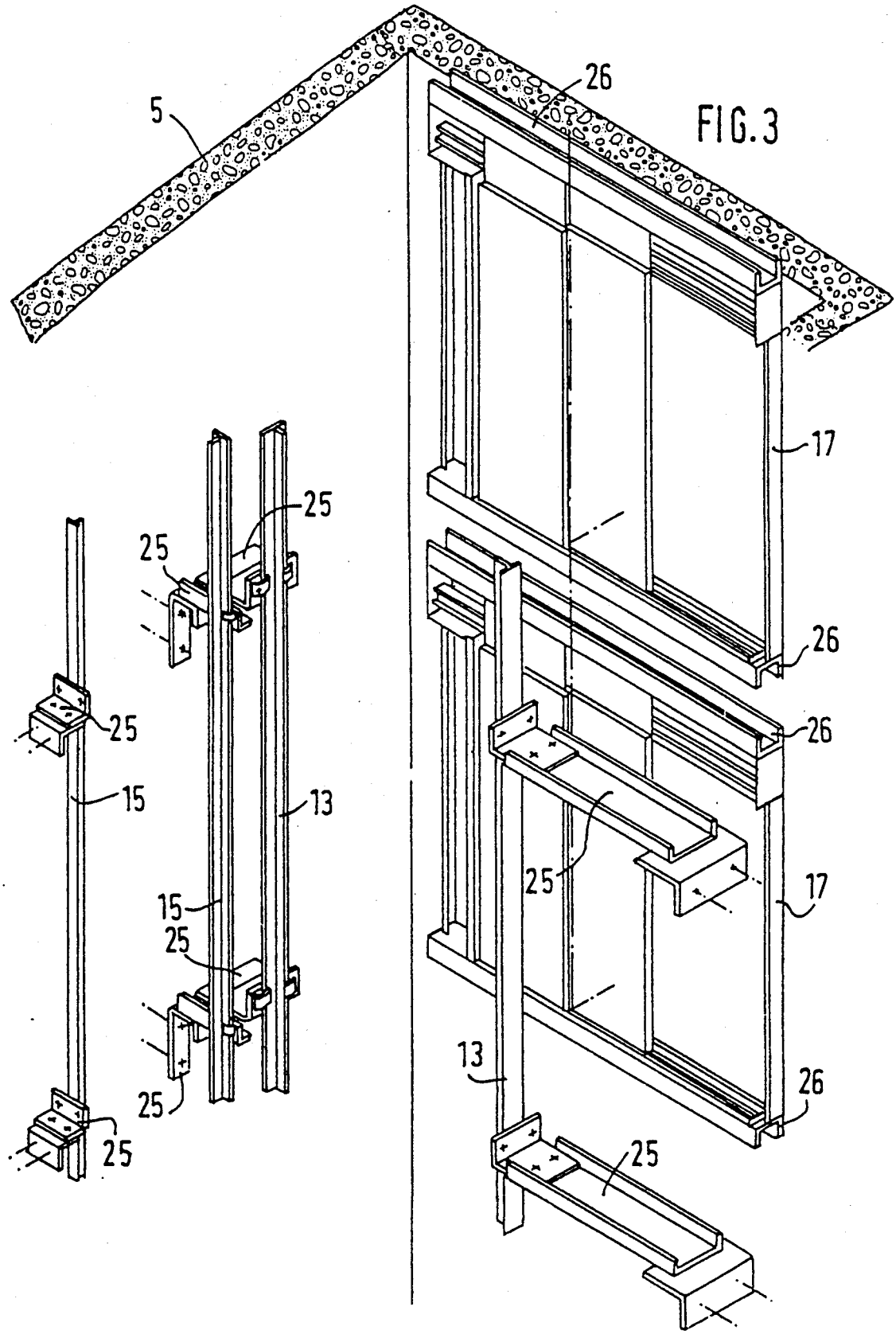
FIG. 3 shows the equipment elements fixed to the lift shaft, the assembly jig having been removed.

When these elements are fixed to the shaft, they may be released from the jig. The latter may then be removed, by means of a crane for example, after its fixing points to the shaft have been freed. At this time, the assembly of the elements is set up on the two levels of the shaft as they appear in FIG. 3. The rails 13 of the cabin, the rails 15 of the counterweight and the doors 17 can in particular be seen there. The electric elements, not shown, will be fitted in the free space. The rails 13, 15 from one jig to the next are connected together by plates (fish plates) not shown bolted to their back. It will be noted that the rails may slide vertically on the bolts 19 if need be for the perfect continuity of the assembled rails.

The jig once removed can be re-used for further cycles of fitting said lift elements, successively heightwise. The cabin counterweight may be brought with the first jig laid at the previously formed shaft bottom of the lift and the lift cabin will be brought with the last jig to be mounted at the top of the shaft.

Figure 5:
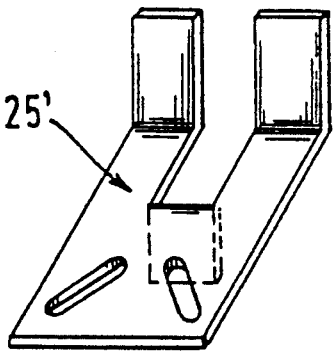
FIGS. 5 and 6 show respectively a guide rail fixing lug and sealing thereof in the wall of the shaft when the latter is made from cast concrete after positioning of the jig.
Figure 6:
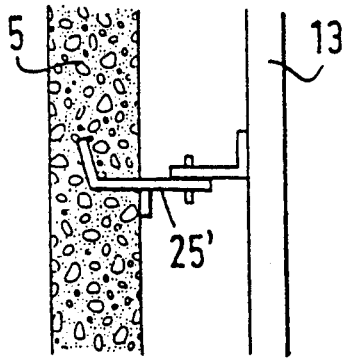

It will also noted that the jigs may be laid before the support shaft has been built. The latter may be cast from concrete. The fixing lugs 25', of a special shape, (FIGS. 5 and 6) will be sealed directly into the mass of the cast concrete. After drying, the elements are fixed to the shaft, the jig may be removed in the same way as before.

The jigs may further be positioned after the structure of the building has been finished; it is sufficient to leave the shaft open at its top so that the jigs may be lowered inside.

The height of the jig has been chosen in the example equal to two floors, but a height of one to several floors of the building may also be suitable.

Shoes, possibly wheels, may equip the jig laterally for facilitating guidance thereof in the shaft and ensuring the protection of the equipment carried.

We claim:

1. A method of assembling an elevator within a building including a support shaft either already constructed or to be constructed which comprises the steps of:

positioning and fixing the guide and equipment elements for the lift, on at least one jig means (1) of predetermined height, such that they are disposed geometrically within the space of the jig means with respect to each other in the position which they will occupy when finally mounted in the support shaft (5);

positioning and fixing the jig means (1) successively heightwise from the previously formed shaft bottom upwardly, in the support shaft (5);

fixing said guide and equipment elements (13, 15, 17) of the elevator carried by the jig means to the shaft releasing said guide and equipment elements (13, 15, 17) from the jig means when they are fixed to the support shaft (5); and removing the jig means from said support shaft (5).

2. A method of assembling an elevator according to claim 1, wherein the step of fixing said guide and equipment elements to the shaft further comprises that the building of the support shaft (5) precedes assembly of the lift elements (13, 15, 17) over at least the height of the jig means (1).

3. A method of assembling a lift or goods lift according to claim 1, wherein the step of fixing said guide and equipment elements to the shaft further comprises that the shaft (5) is made from cast concrete after the jig means (1) has been positioned, and further comprising the step of securing the fixing points (25') of said elements directly in the cast concrete.

4. An assembly jig used for assembling an elevator in a building within a support shaft already constructed or to be constructed which comprises: a rigid frame (3) whose height is at least equal to one floor of the building and whose dimensions in the horizontal plane are slightly less than those of the inner section of the support shaft (5) for allowing introduction of the frame inside the support shaft, said frame (3) including means for simultaneously securing guide and equipment elements (13, 15, 17) of the elevator in a position to which they would be mounted to the shaft and at least one scaffolding level (9) suitable for supporting assembly personnel.

5. An assembly jig as set forth in claim 4, and further comprising bolt elements (19) for securing rails (13, 15) to the assembly jig.

6. An assembly jig according to one of claims 4 or 5, which further comprises said bolt elements (19) defining a groove (23) widening in the downward direction for receiving the upper part of the underlying lower guide rails already fixed to the support shaft (5) during positioning of the jib to thereby align the lower portions of rails affixed by bolt elements 19 to the jig with the upper part of the underlying lower guide rails.

7. An assembly jig according to claim 4 which further comprises mechanical jack means (24), disposed in a pattern to allow these jack means to position the jig by interaction of the jack means with fixed portions of the building to position the jig.

* * * * *